US010870991B2

(12) United States Patent
Brakeman et al.

(10) Patent No.: US 10,870,991 B2
(45) Date of Patent: Dec. 22, 2020

(54) TRUSS MEMBER CONNECTOR, REINFORCED TRUSS, AND TRUSS REINFORCING METHOD

(71) Applicant: Illinois Tool Works Inc., Glenview, IL (US)

(72) Inventors: David Bruce Brakeman, Saint Charles, MO (US); Stuart Lee Lewis, Kissimmee, FL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 16/112,001

(22) Filed: Aug. 24, 2018

(65) Prior Publication Data

US 2019/0093361 A1 Mar. 28, 2019

Related U.S. Application Data

(60) Provisional application No. 62/561,798, filed on Sep. 22, 2017.

(51) Int. Cl.
*E04C 3/16* (2006.01)
*E04C 3/17* (2006.01)
(Continued)

(52) U.S. Cl.
CPC ..... *E04C 3/16* (2013.01); *E04B 1/2608* (2013.01); *E04B 7/022* (2013.01); *E04C 3/17* (2013.01); *E04B 2001/2644* (2013.01)

(58) Field of Classification Search
CPC . E04C 3/16; E04C 3/17; E04B 1/2608; E04B 7/022; E04B 2001/2644
See application file for complete search history.

(56) References Cited

U.S. PATENT DOCUMENTS 2,255,321 A * 9/1941 Kress ..... E04B 1/2608 403/230
3,304,106 A * 2/1967 McCormack ..... E04C 3/17 403/306

(Continued)

FOREIGN PATENT DOCUMENTS

| | | |
|---|---|---|
| GB | 1 462 482 | 1/1977 |
| WO | WO 2016/191426 | 12/2016 |
| WO | WO 2016/191428 | 12/2016 |

OTHER PUBLICATIONS

"Eliminator® Factory-installed T-Bracing," product literature from MiTek® Industries Inc., available prior to Sep. 22, 2017 (1 page).

(Continued)

*Primary Examiner* — Rodney Mintz
(74) *Attorney, Agent, or Firm* — Neal, Gerber & Eisenberg LLP

(57) ABSTRACT

The present disclosure provides in various embodiments a truss member connector including a first attachment section, a second attachment section, a connection section connecting the first attachment section to the second attachment section, and one or more guide pins. The present disclosure provides in various embodiments a reinforced truss and a method for reinforcing a truss member of a truss with the additional reinforcing member which includes attaching an additional reinforcing member to the truss member with a plurality of truss member connectors to enable rotation of the additional reinforcing member relative to the truss member such that the additional reinforcing member adds support and rigidity to the truss member and the entire truss.

13 Claims, 10 Drawing Sheets

(51) Int. Cl.
*E04B 1/26* (2006.01)
*E04B 7/02* (2006.01)

(56) References Cited

U.S. PATENT DOCUMENTS 3,305,252 A * 2/1967 Jureit ..... F16B 15/0046 403/170
3,427,055 A * 2/1969 Coovert ..... F16B 15/0046 217/65
3,498,171 A * 3/1970 Jureit ..... F16B 15/0046 411/466
3,727,354 A 4/1973 Powell
4,376,362 A 3/1983 Jackson
4,455,805 A 6/1984 Rionda et al.
4,483,120 A 11/1984 Gottlieb
4,561,230 A 12/1985 Rionda et al.
4,562,683 A 1/1986 Gottlieb
4,570,407 A 2/1986 Palacio et al.
4,665,677 A 5/1987 Palacio et al.
4,782,641 A 11/1988 Manenti et al.
5,410,854 A * 5/1995 Kimmell ..... E04B 1/2608 411/465
5,553,961 A 9/1996 Olden
5,950,392 A 9/1999 Short, V et al.
6,148,579 A 11/2000 Rolf
6,393,794 B1 5/2002 Pellock
6,430,887 B1 8/2002 Daudet
6,993,882 B2 2/2006 Crawford et al.
7,293,390 B2 * 11/2007 Roesset ..... E04B 7/045 52/702
8,245,479 B2 * 8/2012 Gannon ..... E04C 3/005 52/641
8,683,772 B2 4/2014 Friis
9,670,676 B2 6/2017 Sirowatka
9,920,514 B1 * 3/2018 Brekke ..... E04B 7/06
2005/0086897 A1 * 4/2005 Roesset ..... E04B 7/045 52/698
2010/0269445 A1 * 10/2010 Gannon ..... E04C 3/005 52/645
2015/0075107 A1 3/2015 Wert et al.
2016/0145867 A1 5/2016 Kennelly et al.
2018/0073239 A1 * 3/2018 Brekke ..... E04B 7/06

OTHER PUBLICATIONS

"Gang-Nail® Eliminator MkII," product literature from MITek Australia Ltd., available prior to Sep. 22, 2017 (2 pages).
"BCSI-B10: Post Frame Truss Installation, Restraint and Bracing" from Building Component Safety Information (BCSI) by SBCA and TPI, pp. 84-85, available prior to Sep. 22, 2017 (2 pages).
"Web-Block™ Engineered Bracing Solution from Alpine," flier from Alping Engineered Products, available prior to Sep. 22, 2017 (1 page).

* cited by examiner

TRUSS MEMBER CONNECTOR, REINFORCED TRUSS, AND TRUSS REINFORCING METHOD

PRIORITY

This application claims priority to and the benefit of U.S. Provisional Patent Application Ser. No. 62/561,798, filed Sep. 22, 2017, the entire contents of which are incorporated herein by reference.

BACKGROUND

Wooden trusses are widely used throughout the construction industry. Wooden trusses are typically constructed from conventional dimensional lumber members (such as what is commonly known as a 2 by 4; a 2 by 6; a 2 by 8; etc). The wooden members that are used to form or construct a wooden truss are sometimes called truss members in general with the most common truss member types sometimes called web members and chord members. A wooden truss is typically formed from several wooden truss members, conventional metal connectors, and conventional metal fasteners (such as nails or screws). The metal connectors and metal fasteners are used to attach the truss members together to form the wooden truss.

Wooden trusses are often prefabricated in a factory and then shipped to a construction site where the wooden trusses are used to construct the roof structure of a building (such as a house or commercial facility). Such buildings with roof structures constructed using prefabricated wooden roof trusses are typically more economical and faster to construct than buildings constructed with conventional stick framed roof structures.

However, certain issues exist with certain known wooden trusses, and particularly prefabricated wooden trusses. In certain situations where prefabricated wooden trusses are employed to form a roof structure, one or more of the individual truss members can be subjected to significant loads (such as from snow on the roof structure), and thus be subjected to significant compression forces or loads. In such situations, the truss members such as the web members can sometimes buckle, resulting in a failure of the wooden truss and possibly part of or the entire roof structure.

Different types of wooden truss strengthening or reinforcing mechanisms have been added to or used with wooden trusses to prevent such truss members from buckling or otherwise failing under such significant compression forces or loads. The purposes of such wooden truss reinforcing mechanisms are typically to hold the vertical position of the wooden truss, maintain the spacing of the truss members of the wooden truss, and reduce the likelihood of buckling or failure of any of the individual truss members of the wooden truss when under a compression load.

One known method for adding reinforcing mechanisms to wooden trusses is to attach one or more reinforcing metal braces to one or more of the individual truss members of the truss. This adds a significant step to the manufacture of the prefabricated wooden trusses (in part because it cannot be easily done on automatic truss manufacturing tables), is relatively time consuming, and is relatively expensive.

Another known method for adding reinforcing mechanisms to wooden trusses is to attach an additional reinforcing wooden member (such as an additional 2 by 4) to one of the individual truss members of the wooden truss.

More specifically, it is known to add such an additional reinforcing wooden member in the same plane as the truss member that is being strengthened. In such cases, metal connectors are typically employed on both sides of both of the additional reinforcing wooden member and the truss member to attach such members together. This can be done with typical assembly equipment used to make prefabricated wooden trusses, but in certain cases does not add sufficient strength or rigidity to the truss member that is being strengthened.

It is also known to add such an additional reinforcing wooden member perpendicular to the truss member that is being strengthened or reinforced. In such cases, metal fasteners are employed to attach the additional reinforcing wooden member to the truss member at the 90 degree angle. While this adds sufficient strength or rigidity to the truss member that is being strengthened, it must be done in the field at the construction site because, if done in a factory, such 90 degree additional reinforcing wooden members would interfere with the stacking and shipping of such wooden truss members, or dramatically increase the cost of such shipping. Thus, the addition of such 90 degree additional reinforcing wooden members to a wooden truss is typically done at the construction site by the builder or framer either before or after the wooden truss is erected to form the roof structure. In either case, such additional reinforcing wooden members must be transported to the location of the wooden truss and attached to truss members that are being strengthened. Such on-site installation of such additional reinforcing wood members is thus often complicated (if done after installation of the wooden truss to form the roof structure), costly, and time consuming. Such on-site truss reinforcing can also sometimes be done incorrectly, and can sometimes be inadvertently or intentionally not done at all.

Accordingly, there is a need to solve the above problems.

SUMMARY

The present disclosure provides a truss member connector, a reinforced truss, and a method of reinforcing a truss member of a wooden truss that overcomes the above described problems.

In various embodiments, the truss member connector of the present disclosure is configured to be employed to attach a reinforcing or reinforcement mechanism to a wooden truss, and specifically to attach or connect an additional reinforcing wooden member (such as an additional 2 by 4) to one of the individual truss members (such as one of the web members) of the wooden truss in the same plane as that truss member that is being strengthened. In various embodiments, the additional reinforcing wooden member is attached or connected to the individual truss member of the wooden truss using a plurality of the truss member connectors of the present disclosure. The truss member connectors are configured to bend to enable rotation of the additional reinforcing wooden member from being in the same or substantially the same plane as the truss member being strengthened into a position perpendicular to or substantially perpendicular to the truss member being strengthened (such as into a generally L shape). The rotated additional reinforcing wooden member and the truss member connectors add structural support and rigidity to the individual truss member of the wooden truss, and thus to the entire wooden truss.

In various embodiments, the additional reinforcing wooden member can be attached to the individual truss member of the wooden truss in the same or substantially the same plane as such individual truss member while the wooden truss is being fabricated in a factory or manufacturing plant. This reinforced prefabricated wooden truss can then be shipped "flat" to a construction site, and a builder or framer at the construction site can easily manually rotate the additional reinforcing wooden member into a position perpendicular to or substantially perpendicular to that individual truss member being strengthened (such as into a generally L shape). Such on-site rotation of the additional reinforcing wood member substantially reduces the complications, time consumption, and cost associated with on-site wooden truss strengthening or reinforcing, and substantially increases the chances that such strengthening or reinforcing will be done correctly and not inadvertently or intentionally omitted.

Additional features and advantages of the present disclosure are described in, and will be apparent from, the following Detailed Description and the Figures.

DETAILED DESCRIPTION OF EXAMPLE EMBODIMENTS

Figure 1:
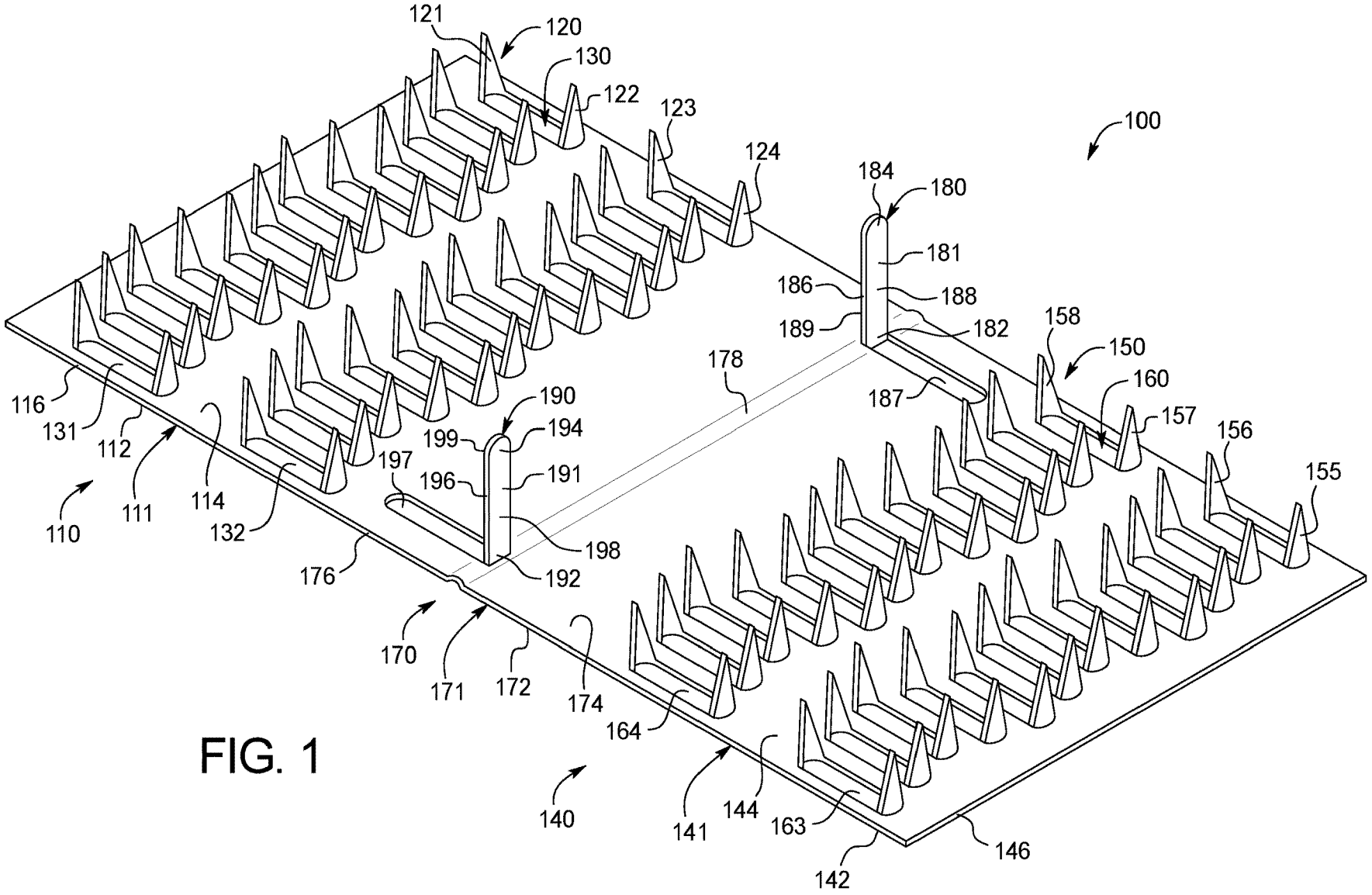
FIG. 1 is a bottom perspective view of a truss member connector of one example embodiment of the present disclosure.

The present disclosure provides a truss member connector, a reinforced truss, and a method of reinforcing a truss member that overcome the above described problems. An example embodiment of the truss member connector of the present disclosure is discussed below; however, it should be appreciated that the present disclosure is not limited to the example truss member connector, reinforced truss, or the method of reinforcing a truss member.

EXAMPLE EMBODIMENT

Referring now to FIGS. 1 to 8, one example embodiment of a truss member connector and a reinforcing method of the present disclosure is generally illustrated. The truss member connector of this example illustrated embodiment is generally indicated by numeral 100.

The example illustrated truss member connector 100 generally includes: (a) a first attachment section 110; (b) a second attachment section 140; (c) a connection section 170 connecting the first attachment section 110 to the second attachment section 140; (d) a first guide pin 180; and (e) a second guide pin 190. In this illustrated embodiment, the first attachment section 110 is integrally connected to one end of the connection section 170, and the second attachment section 140 is integrally connected to the opposite end of the connection section 170. In this illustrated embodiment, the first guide pin 180 and the second guide pin 190 are each integrally connected to and extend from one side of the connection section 170. It should be appreciated that in other embodiments of the present disclosure, these components can be otherwise suitably formed and otherwise suitably connected.

Figure 6:
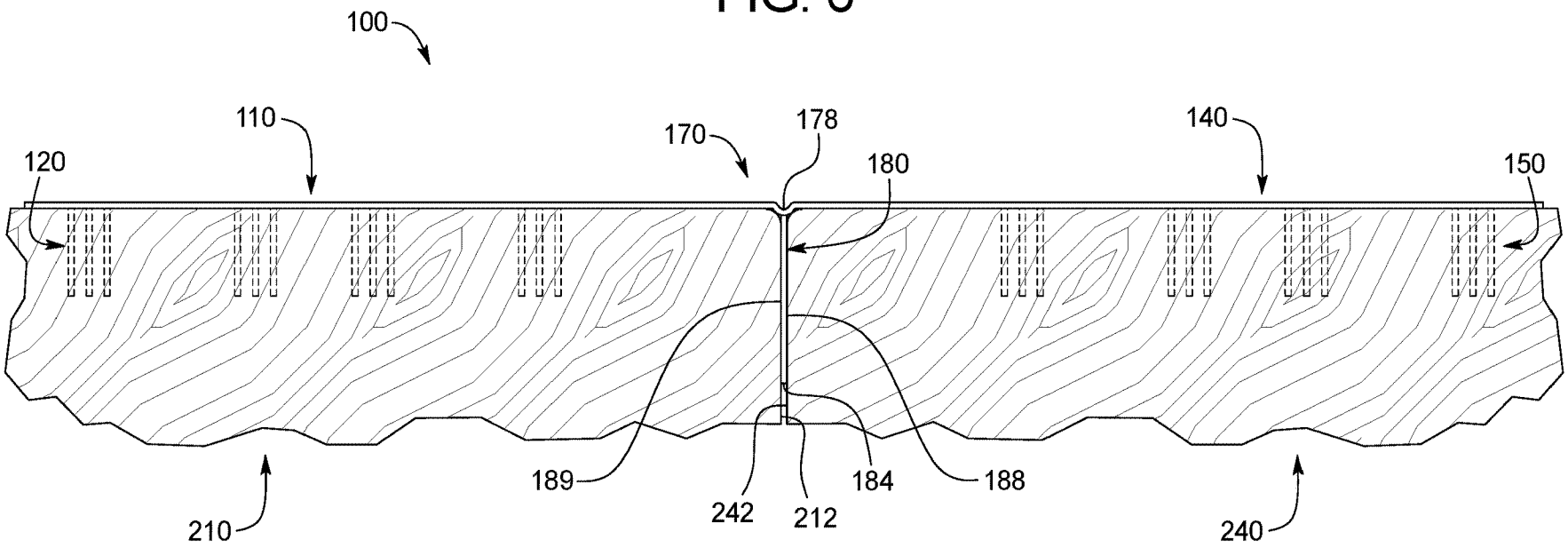
FIG. 6 is a cross sectional view of the truss member connector of FIG. 1 installed in an additional reinforcing member and an adjacent truss member of a truss after its embedment and prior to bending the truss member connector.

More specifically, the first attachment section 110 includes: (a) a first generally flat body 111 having a top surface 112, a bottom surface 114 opposite the top surface 112, and an edge 116; (b) a first set of attachment teeth 120 extending from the bottom surface 114; and (c) a first set of holes 130 defined in the first flat body 111. The first set of attachment teeth 120 includes: (a) a first row of attachment teeth 121, (b) a second row of attachment teeth 122, (c) a third row of attachment teeth 123, and (d) a fourth row of attachment teeth 124 (as best shown in FIG. 1). The first set of attachment teeth 120 are configured to be automatically or manually pressed (such as pressed, hammered, driven, inserted, etc.) into a first truss member 210 to fasten the first attachment section 110 to first truss member 210 (as best shown in FIG. 6).

Figure 2:
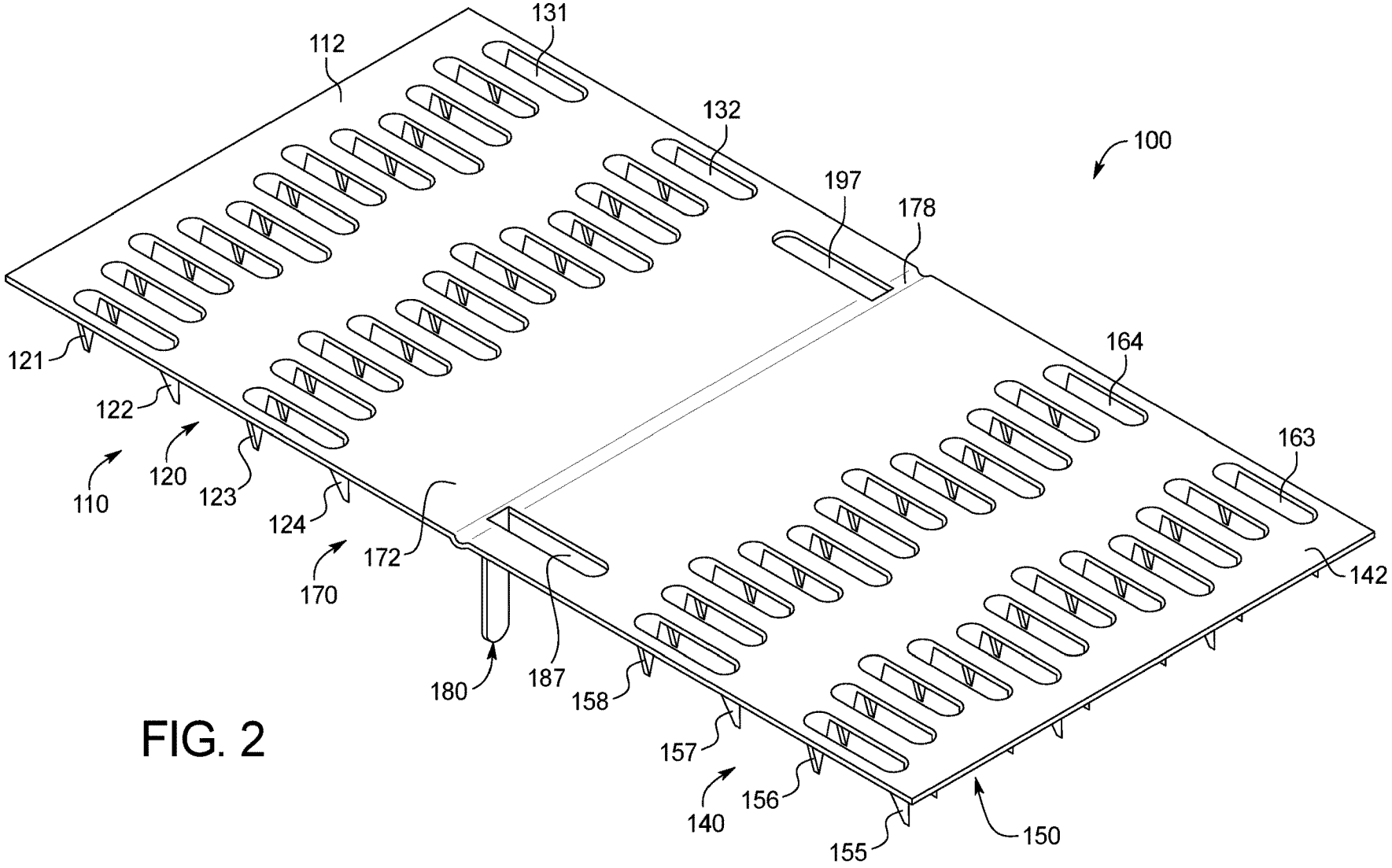
FIG. 2 is a top perspective view of the truss member connector of FIG. 1.

When the truss member connector 100 is formed, the first generally flat body 111 is stamped to form the first set of attachment teeth 120 and the first set of holes 130 in a conventional manner. That is, the material of the first set of attachment teeth 120 is bent away from the first flat body 111, leaving the first set of holes 130 behind (as best shown in FIG. 1). Each of the first set of holes 130 extend through the first flat body 111 and are arranged in a first row 131 and a second row 132. The first row of holes 131 is between the first and second rows of attachment teeth 121 and 122. The second row of holes 132 is between the third and fourth rows of attachment teeth 123 and 124. The first and second rows of holes 131 and 132 and the first, second, third, and fourth rows of attachment teeth 121, 122, 123, and 124 are in a wave-shaped pattern (as best shown in FIG. 2) in this example illustrated embodiment.

The second attachment section 140 includes: (a) a second generally flat body 141 having a top surface 142, a bottom surface 144 opposite the top surface 142, and an edge 146; (b) a second set of attachment teeth 150 extending from the bottom surface 144; and (c) a second set of holes 160 defined in the second flat body 141. The second set of attachment teeth 150 includes: (a) a fifth row of attachment teeth 155, (b) a sixth row of attachment teeth 156, (c) a seventh row of attachment teeth 157, and (d) an eighth row of attachment teeth 158 (as best shown in FIG. 1). The second set of attachment teeth 150 are configured to be pressed into an additional reinforcing member that is referred to in this example embodiment as a second truss member 240 to fasten the second attachment section 140 to the additional reinforcing member or the second truss member 240 (as best shown in FIG. 6).

When the truss member connector 100 is formed, the second generally flat body 141 is stamped to form the second set of attachment teeth 150 and the second set of holes 160 in a conventional manner. That is, the material of the second set of attachment teeth 150 is bent away from the second flat body 141, leaving the second set of holes 160 behind (as best shown in FIG. 1). Each of the second set of holes 160 extend through the second flat body 141 and are arranged in a third row 163 and a fourth row 164. The third row of holes 163 is between the fifth and sixth rows of attachment teeth 155 and 156. The fourth row of holes 164 is between the seventh and eighth rows of attachment teeth 157 and 158. The third and fourth rows of holes 163 and 164 and the fifth, sixth, seventh, and eighth rows of attachment teeth 155, 156, 157, and 158 are in a wave-shaped pattern (as best shown in FIG. 2) in this illustrated example embodiment.

Figure 3:
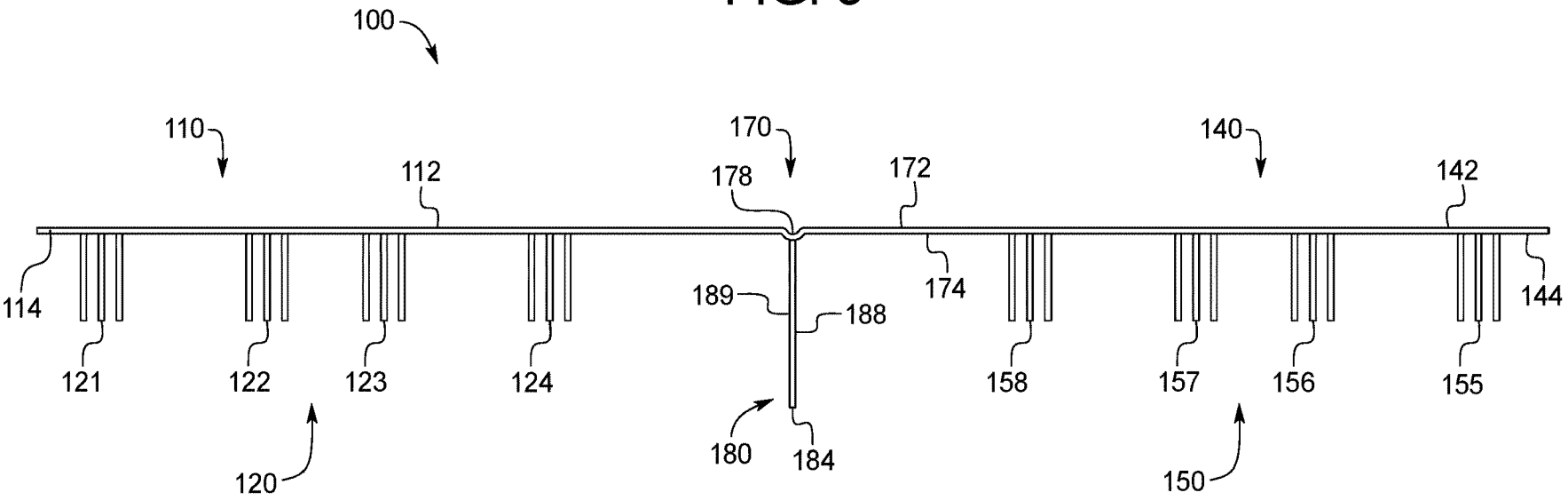
FIG. 3 is a side view of a truss member connector of FIG. 1.
Figure 7:
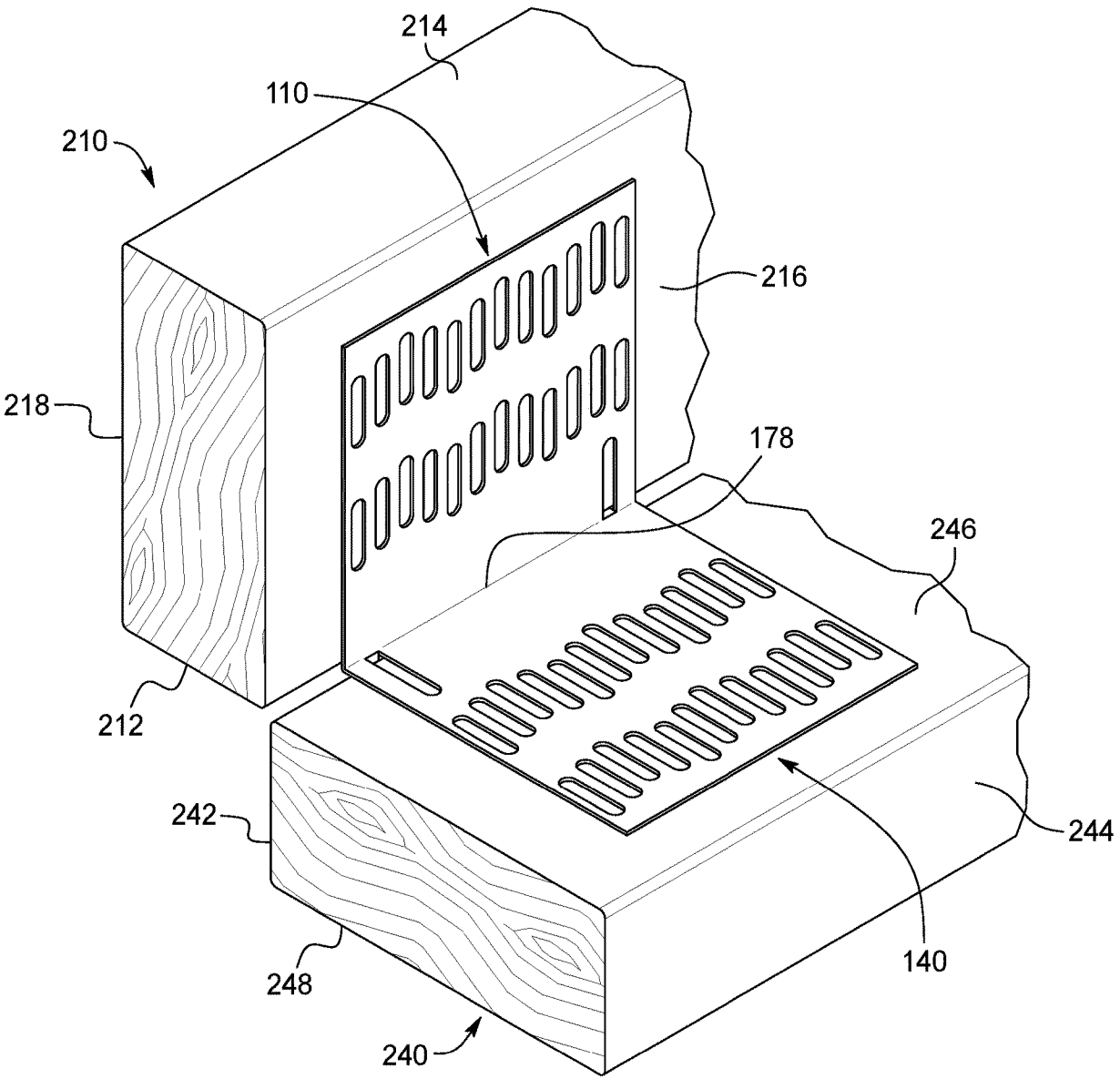
FIG. 7 is a top perspective view of the truss member connector of FIG. 1 installed on an additional reinforcing member and an adjacent truss member of a truss after bending the truss member connector.
Figure 8:
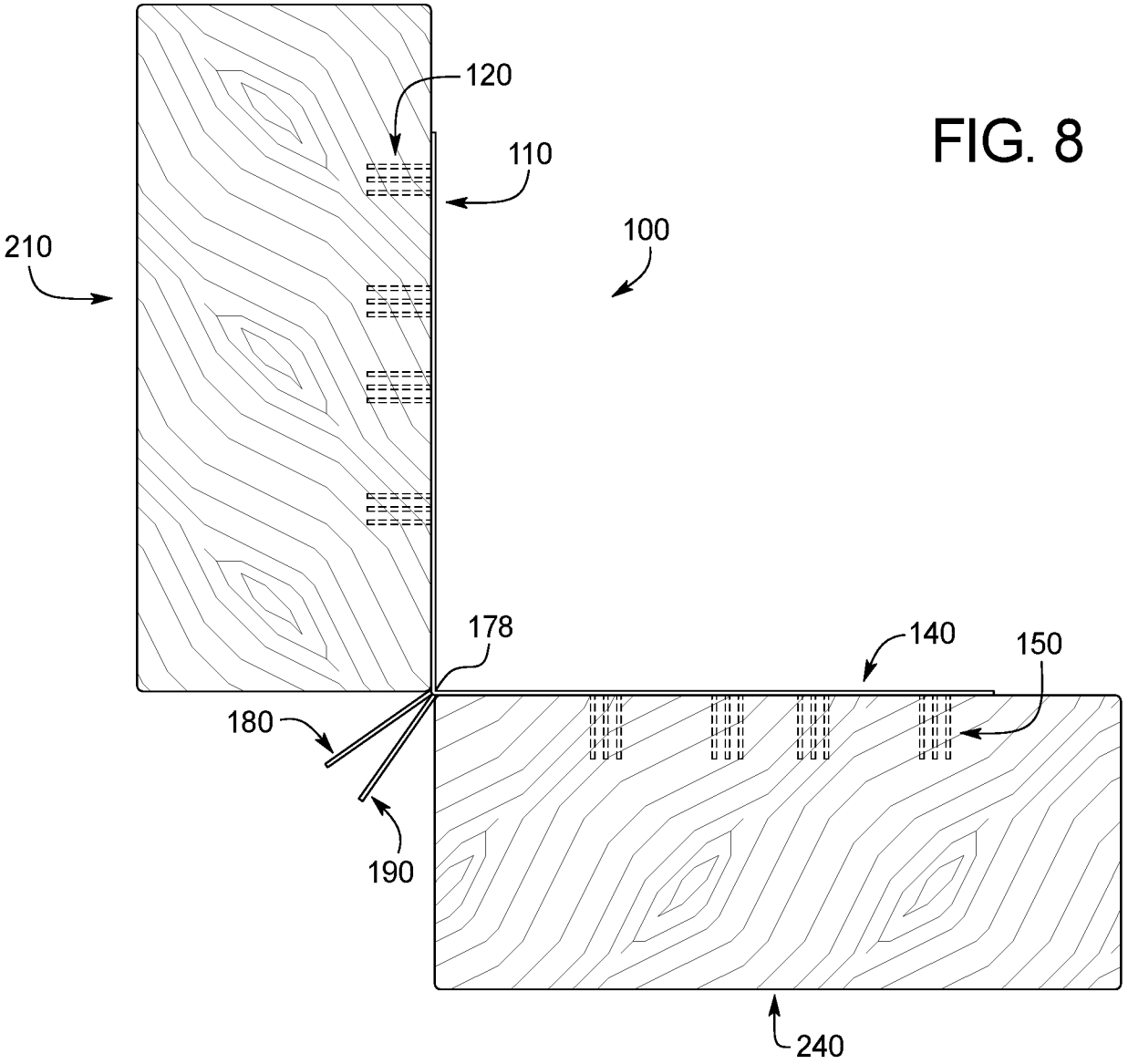
FIG. 8 is an end view of the truss member connector of FIG. 1 installed on an additional reinforcing member and an adjacent truss member of a truss after bending the truss member connector.

The connection section 170 includes: (a) a third body 171 having a top surface 172, a bottom surface 174 opposite the top surface 172, and an edge 176; and (b) a crease or indentation 178 in the third body 171. The indentation 178 is concave with respect to the top surface 172 and convex with respect to the bottom surface 174 (as best shown in FIGS. 3 and 6). The indentation 178 thus points in the same direction as the first and second sets of attachment teeth 120 and 150. The indentation 178 is generally aligned with the rows of attachment teeth 121, 122, 123, 124, 155, 156, 157, and 158 and the holes 131, 132, 163, and 164. The indentation 178 is configured to facilitate or assist in the bending of the truss member connector 100 along a desired bend line or axis and in a desired direction into a generally L shape along the indentation 178 when the additional reinforcing member or second truss member 240 is rotated relative to the first truss member 210 (as best shown in FIGS. 7 and 8). Thus, as further explained below, in operation, the additional reinforcing member or second truss member 240 can be rotated relative to the first truss member 210 to generally form an L shape with the truss member connector 100 acting as the corner of the L shape after the first and second attachment sections 110 and 140 are respectively fastened to the first and second truss members 210 and 240 (as best shown in FIGS. 7 and 8).

The first guide pin 180 includes a flat finger 181 having an attachment end 182, a free end 184, and an edge 186 (as best shown in FIG. 1). When the truss member connector 100 is formed, the third body 171 is stamped to form the first guide pin 180 in a conventional manner. That is, the material of the first guide pin 180 is bent away from the third body 171, leaving a hole 187 behind (as best shown in FIG. 1). The hole 187 extends through the third body 171. The first guide pin 180 is attached to the connection section 170 at the attachment end 182 (as best shown in FIG. 1). The first guide pin 180 extends from the bottom surface 174 of the connection section 170 near the indentation 178 (as best shown in FIGS. 1 and 3). The first guide pin 180 extends transversely from the third body 171 and in particular is generally perpendicular to the third body 171 (as best shown in FIG. 3) in this illustrated example embodiment. The flat finger 181 has a first side 188 and a second side 189 opposite the first side 188.

Figure 4:
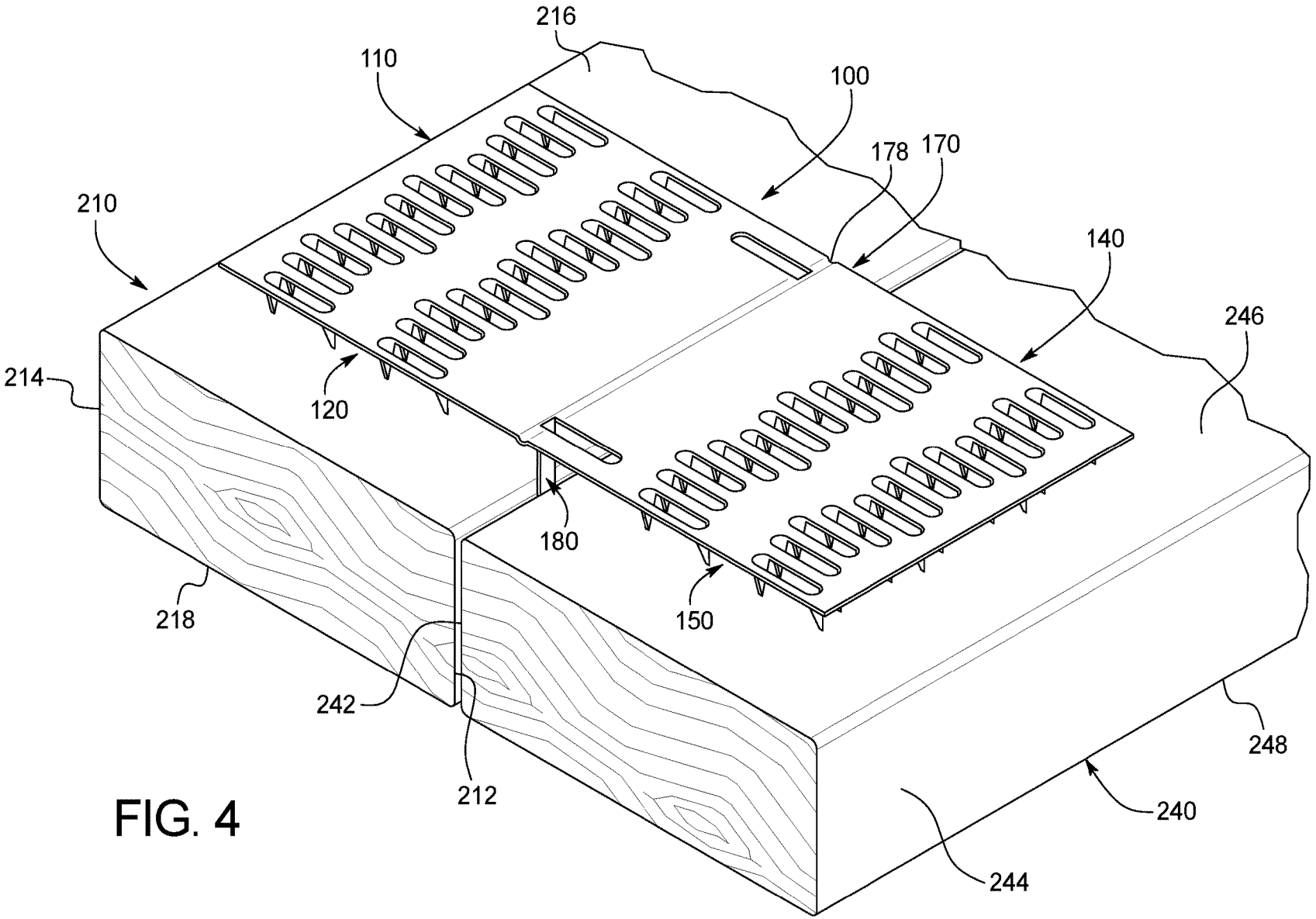
FIG. 4 is a top perspective view of the truss member connector of FIG. 1 positioned for installation on an additional reinforcing member and an adjacent truss member of a truss prior to its embedment and prior to bending the truss member connector.
Figure 5:
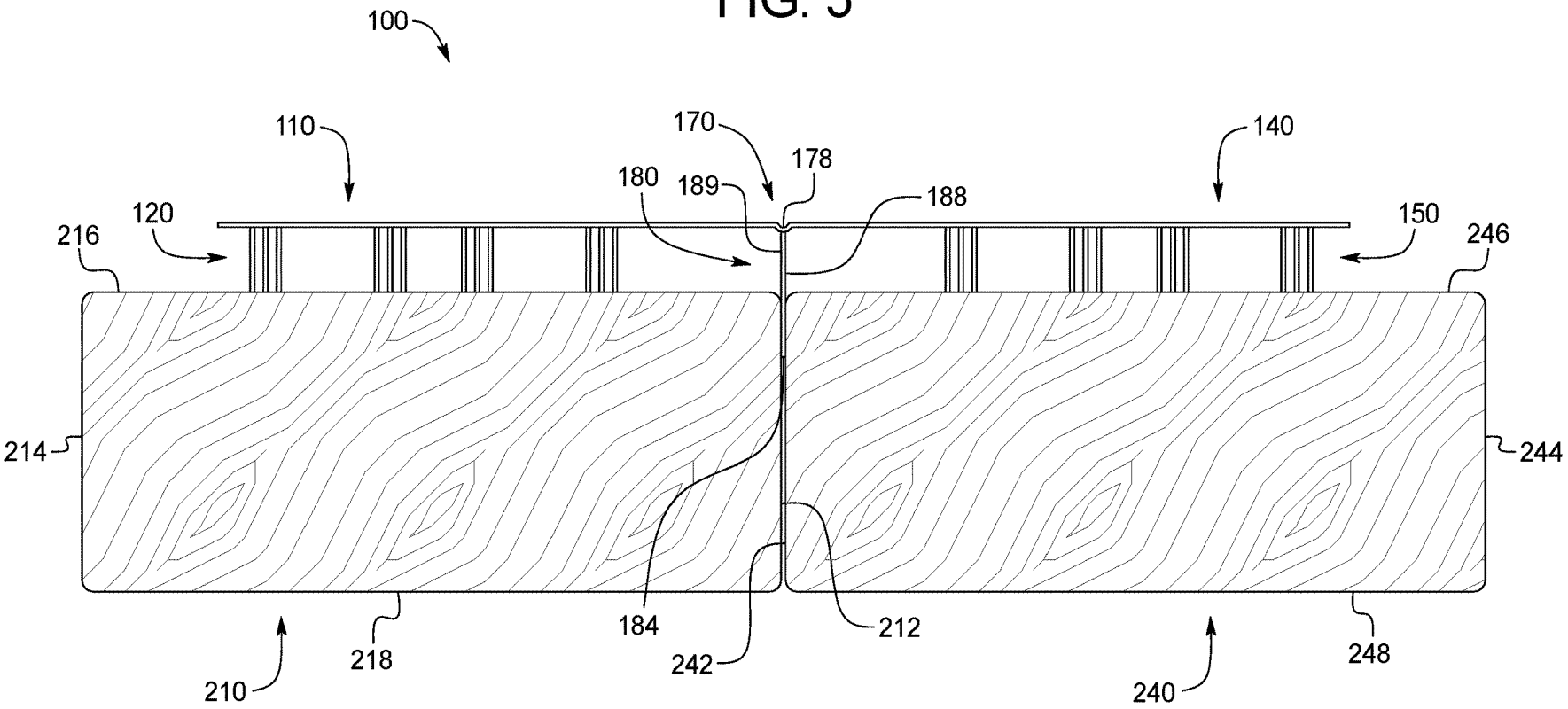
FIG. 5 is a side view of the truss member connector of FIG. 1 positioned for installation on an additional reinforcing member and an adjacent truss member of a truss prior to its embedment and prior to bending the truss member connector.

The first guide pin 180 is longer than each of the attachment teeth of the first and second sets of attachment teeth 120 and 150 (as best shown in FIGS. 3 to 6). The first guide pin 180 is configured to extend between the first and second truss members 210 and 240 to align the indentation 178 with the first and second truss 210 and 240 members before the first and second sets of attachment teeth 120 and 150 are embedded into the first and second truss members 210 and 240 (as best shown in FIG. 4). The first and second sides 188 and 189 of the flat finger 181 are configured to contact the opposing facing sides 212 and 242 of the first and second truss members 210 and 240 (as best shown in FIGS. 4 to 6). The first and second sides 188 and 189 of the flat finger 181 are also configured to slide along the opposing facing sides 212 and 242 of the first and second truss members 210 and 240 (as best shown in FIGS. 4 to 6).

The second guide pin 190 includes a flat finger 191 having an attachment end 192, a free end 194, and an edge 196 (as best shown in FIG. 1). When the truss member connector 100 is formed, the third body 171 is stamped to form the second guide pin 190 in a conventional manner. That is, the material of the second guide pin 190 is bent away from the third body 171, leaving a hole 197 behind (as best shown in FIG. 1). The hole 197 extends through the third body 171. The second guide pin 190 is attached to the connection section 170 at the attachment end 192 (as best shown in FIG. 1). The second guide pin 190 extends from the bottom surface 174 of the connection section 170 near the indentation 178 (as best shown in FIGS. 1 and 3). The second guide pin 190 extends transversely from the third body 171 and in particular is generally perpendicular to the third body 171 (as best shown in FIG. 3). The flat finger 191 has a first side 198 and a second side 199 opposite the first side 198.

The second guide pin 190 is longer than each of the attachment teeth of the first and second sets of attachment teeth 120 and 150 (as best shown in FIGS. 3 to 6). The second guide pin 190 is configured to extend between the first and second truss members 210 and 240 to align the indentation 178 with the first and second truss members 210 and 240 before the first and second sets of attachment teeth 120 and 150 are embedded into the first and second truss members 210 and 240 (as best shown in FIG. 4). The first and second sides 198 and 199 of the flat finger 191 are configured to contact sides 212 and 242 of the first and second truss members 210 and 240 (as best shown in FIGS. 4 to 6). The first and second sides 198 and 199 of the flat finger 191 are configured to slide along sides 212 and 242 of the first and second truss members 210 and 240 (as best shown in FIGS. 4 to 6).

It should be appreciated that the first and second guide pins 180 and 190 extend more deeply between the first and second truss members 210 and 240 as the first and second sets of attachment teeth 120 and 150 are embedded into the first and second truss members 210 and 240 (as best shown in FIGS. 4 to 6). The sides 188, 189, 198, and 199 of the flat fingers 181 and 191 of the first and second guide pins 180 and 190 slide along sides 212 and 242 of the first and second truss members 210 and 240 as the first and second sets of attachment teeth 120 and 150 are embedded into the first and second truss members 210 and 240 (as best shown in FIGS. 4 to 6). It should also be appreciated that the first and second guide pins 180 and 190 are shorter than the sides 212 and 242 of the first and second truss members 210 and 240 (as best shown in FIG. 6). Thus, the first and second guide pins 180 and 190 extend between, but not beyond, the first and second truss members 210 and 240 when the truss member connector 100 is installed.

FIGS. 4 to 8 generally illustrate one method of reinforcing a truss member with an additional reinforcing member in accordance with the present disclosure.

In this illustrated embodiment and in various embodiments of the present disclosure, the present disclosure generally includes using a plurality of truss member connectors 100 to attach an additional reinforcing member such as second truss member 240 to a first truss member such as first truss member 210 of a truss, and rotating the additional reinforcing member relative to the first truss member (and about bending axes of the truss member connectors) such that the additional reinforcing member adds support and rigidity to the first truss member and the entire truss.

Referring back to the drawings, in various embodiments, the method includes: (a) positioning the additional reinforcing member or second truss member 240 relative to the first truss member 210; (b) placing the truss member connectors 100 on the first and second truss members 210 and 240 with the sets of attachment teeth 120 and 150 on the first and second truss members 210 and 240 and the first and second guide pins 180 and 190 between the first and second truss members 210 and 240; (c) embedding the truss member connectors 100 into the first and second truss members 210 and 240 such that the first and second guide pins 180 and 190 extend further between the first and second truss members 210 and 240; and (d) rotating the additional reinforcing member or second truss member 240 relative to the first truss member 210 to form a generally L shape with the truss member connectors 100 acting as the corner of the L shape.

In various embodiments, steps (a), (b), and (c) are performed at a truss manufacturing factory and step (d) is performed at a construction site. In various embodiments, the truss, including additional reinforcing members attached with connectors 100, is thus constructed in a factory. It should be appreciated that the steps (a), (b), and (c) can be done before the truss members are jigged into the rest of the truss or on a truss assembly table.

It should be appreciated that additional reinforcing members may be attached to truss members of a factory-built truss with connectors 100 at a construction site in accordance with the present disclosure.

It should also be appreciated that a truss with the additional reinforcing members may be built at a construction site in accordance with the present disclosure.

More specifically, the method includes positioning the additional reinforcing member or second truss member 240 next to the first truss member 210 such that the second truss member 240 is generally parallel to the first truss member 210 (as best shown in FIG. 4). The first and second truss members 210 and 240 have faces 216, 218, 246, and 248 and sides 212, 214, 242, and 244 and the second truss member 240 is shorter than the first truss member 210. In this illustrated example embodiment, the faces 216, 218, 246, and 248 are wider than the sides 212, 214, 242, and 244 (as best shown in FIG. 4). More specifically, the first and second truss members 210 and 240 are positioned next to one another horizontally on a work surface such that the downward faces 218 and 248 contact the work surface.

In an alternative embodiment, the method further includes arranging the first truss member 210 and the second truss member 240 such that a side 212 of the first truss member 210 contacts a side 242 of the second truss member 240.

The method further includes placing the truss member connector 100 on the first and second truss members 210 and 240 with the first and second guide pins 180 and 190 between the first and second truss members 210 and 240 such that the first and second attachment sections 110 and 140 contact the first and second truss members 210 and 240 (as best shown in FIGS. 4 and 5). More specifically, the first and second guide pins 180 and 190 contact the respective sides 212 and 242 of the first and second truss members 210 and 240, the first set of attachment teeth 120 contacts the upward face 216 of the first truss member 210, and the second set of attachment teeth 150 contacts the upward face 246 of the second truss member 240 (as best shown in FIGS. 4 and 5). This ensures proper alignment and spacing of the first and second truss members 210 and 240. It should be appreciated that the free ends 184 and 194 of the first and second guide pins 180 and 190 are below a plane formed by the upward faces 216 and 246 when the first and second attachment sections 110 and 140 contact the upward faces 216 and 246 (as best shown in FIG. 5).

The method then includes embedding the truss member connector 100 into the first and second truss members 210 and 240, which includes driving the first and second sets of attachment teeth 110 and 140 into the first and second truss members 210 and 240 (as best shown in FIG. 6). More specifically, the first and second sets of attachment teeth 120 and 150 are driven downwardly into the first and second truss members 210 and 240. Automated embedding machinery is preferably used to drive the truss member connector 100 downwardly to fully embed the first and second sets of attachment teeth 120 and 150 which are embedded into the first and second truss members 210 and 240. It should be appreciated that the first and second truss members 210 and 240 are coplanar with one another prior to rotating the second truss 240 member relative to the first truss member 210 (as best shown in FIG. 6). In other words, the reinforcing truss member 240 does not stick out from the thickness of the constructed truss before being rotated to form the generally L shape with the truss member 210 of the truss and the truss member connector 100. This facilitates shipping of the prefabricated truss without additional expense.

In various embodiments, the method then includes transporting the truss from the factory to a construction site. More specifically, constructed trusses are loaded onto a truck (such as a flatbed truck) or trailer at the factory, driven to a construction site, and unloaded from the truck or trailer. It should be appreciated that multiple trusses may be efficiently stacked on top of one another for transport because the first and second truss members are coplanar when made at and when leaving the factory.

The method then includes rotating the additional reinforcing member or second truss member 240 relative to the first truss member 210, which includes bending the truss member connector 100 (as best shown in FIGS. 7 and 8). More specifically, the connecting section 170 bends along the indentation 178 such that the first and second truss members 210 and 240 and the truss member connector 100 form a general L shape or right angle with the connection section 170 acting as the corner of the L (as best shown in FIGS. 7 and 8). It should be appreciated that rotating the second truss member 240 relative to the first truss member 210 may be performed by workers at ground level before using the truss to form part of a roof structure. It should also be appreciated that rotating the second truss member 240 relative to the first truss member 210 increases the compression capacity of the first truss member 210.

The method then includes installing the reinforced truss onto the structure being built at the construction site. The reinforced truss is lifted into place manually or with a crane or other suitable mechanism (such as a forklift) and ends or other bearing locations of the truss are attached to walls, columns or other supporting elements of the structure. The truss can be fastened to roof sheathing, purlins, or other elements of the structure, as specified by the building plans for the structure.

Figure 9:
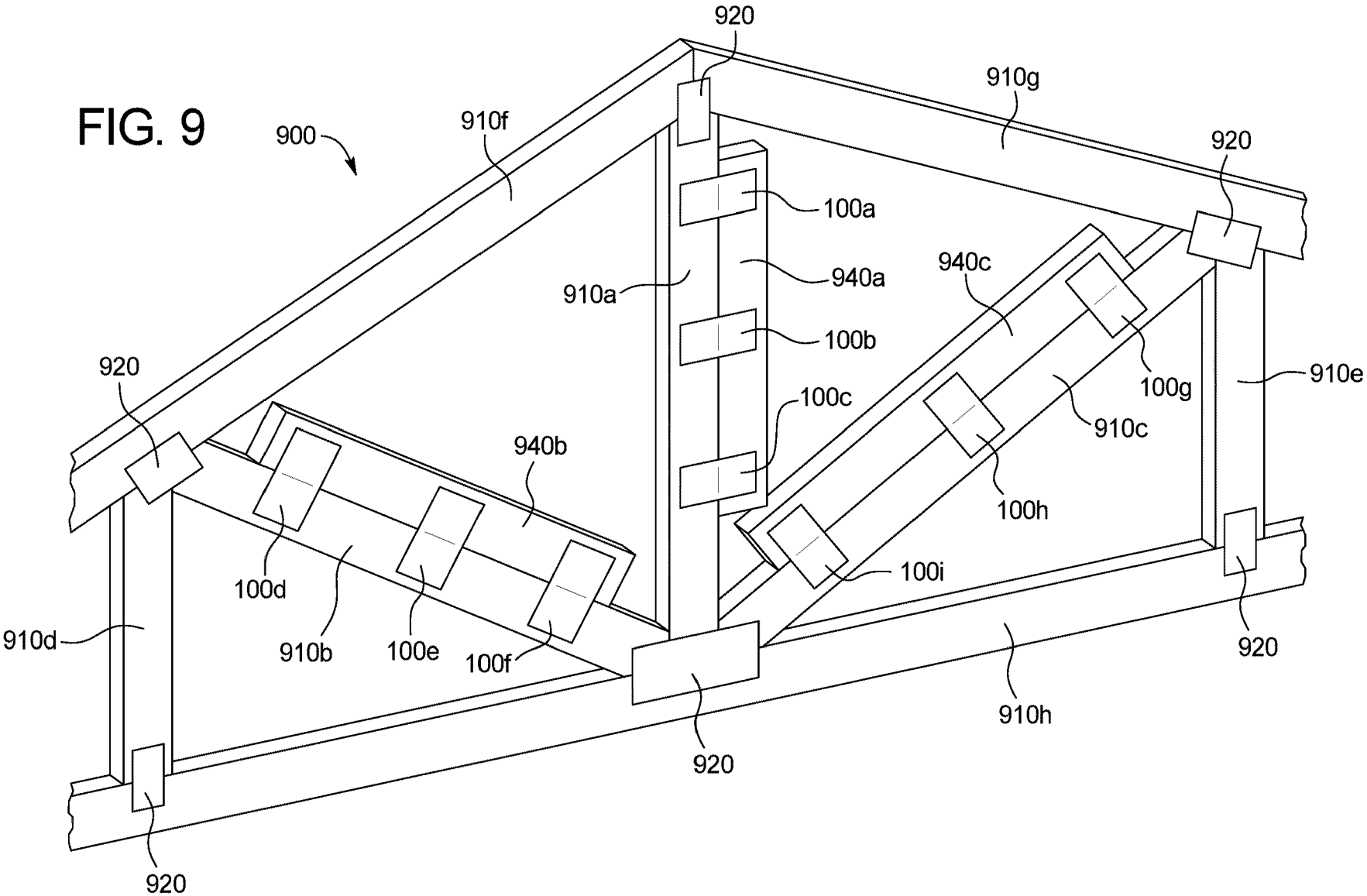
FIG. 9 is a fragmentary perspective view of a reinforced prefabricated wooden truss including three additional reinforcing members each respectively attached to an individual truss member of the truss by three truss member connectors of FIG. 1 prior to bending of any of the truss member connectors.
Figure 10:
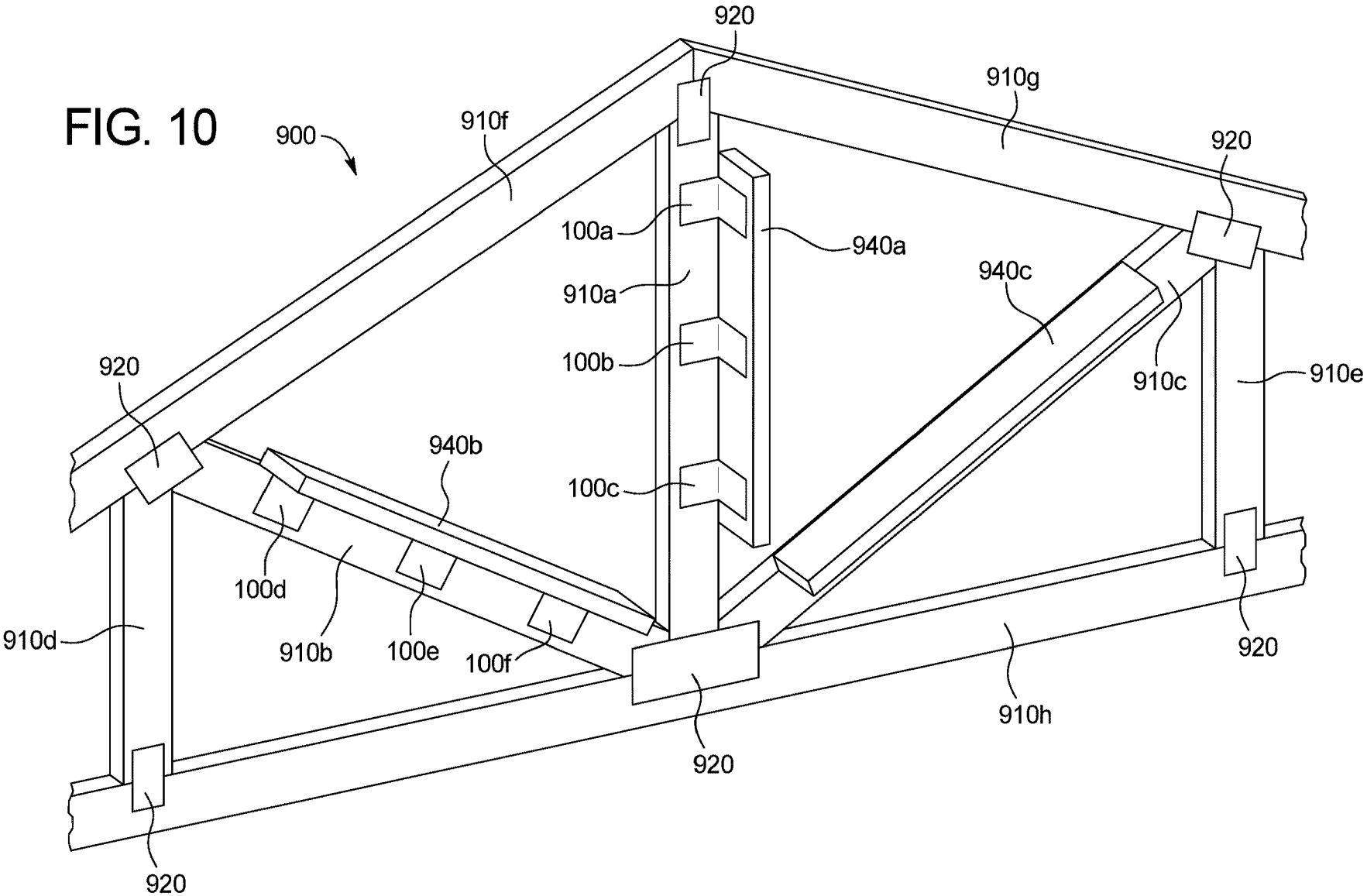
FIG. 10 is a fragmentary perspective view of the reinforced prefabricated wooden truss of FIG. 10 including the three additional reinforcing members each respectively attached to an individual truss member of the truss by three truss member connectors of FIG. 1 after bending of the truss member connectors and rotation of each of the additional reinforcing members to a perpendicular position with respect to the individual truss members being reinforced.

Referring now to FIGS. 9 and 10, an example reinforced truss 900 constructed using a plurality of the illustrated example truss member connector 100 and the truss reinforcing method of the present disclosure is generally illustrated.

The truss 900 generally includes primary truss members 910*a* to 910*h* attached to one another with truss connector plates 920. The truss also generally includes additional reinforcing members 940*a*, 940*b*, and 940*c* respectively attached to primary truss members 910*a*, 910*b*, and 910*c*, which are or will be under compression, with truss member connectors 100*a* to 100*i*. More specifically, primary truss member 910*a* is attached to additional reinforcing member 940*a* with truss member connectors 100*a*, 100*b*, and 100*c*. Primary truss member 910*b* is attached to additional reinforcing member 940*b* with truss member connectors 100*d*, 100*e*, and 100*f*. Primary truss member 910*c* is attached to additional reinforcing member 940*c* with truss member connectors 100*g*, 100*h*, and 100*i*. The truss member connectors 100*a* to 100*i* are spaced approximately 24 inches apart, on center in this example illustrated embodiment.

The truss member connectors 100*a* to 100*i* respectively attach the additional reinforcing members 940*a*, 940*b*, and 940*c* to the primary truss members 910*a*, 910*b*, and 910*c* on only one side of the truss 900. The truss member connectors 100*a* to 100*i* do not attach the additional reinforcing members 940*a*, 940*b*, and 940*c* to the primary truss members 910*a*, 910*b*, and 910*c* on opposite sides of the truss 900. In other words, truss member connectors 100*a* to 100*i* are not installed on the side of the truss 900 opposite to the side of the truss 900 shown in FIGS. 9 and 10. In this illustrated embodiment, the primary truss members 910*a* to 910*h* and the additional reinforcing members 940*a*, 940*b*, and 940*c* are initially arranged in or lie in the same plane as shown in FIG. 9. This is generally referred to herein as being flat. In one such example, they all have the same or substantially the same thickness (such as 1.5 inches). This enables the shipping of stacked reinforced trusses is the same manner as is currently done with known trusses.

Prior to bending the truss member connectors 100*a* to 100*i* (such as, after the truss is fabricated and delivered to a construction site), the primary truss members 910*a* to 910*h* and the additional reinforcing members 940*a* to 940*c* are all in one plane (as best shown in FIG. 9). Workers generally at ground level at the construction site then rotate the additional reinforcing members 940*a*, 940*b*, and 940*c* relative to the primary truss members 910*a*, 910*b*, and 910*c*. When the additional reinforcing members 940*a*, 940*b*, and 940*c* are rotated relative to the primary truss members 910*a*, 910*b*, and 910*c*, the truss member connectors 100*a* to 100*i* each bend along the respective indentations. More specifically, each connection section 170 of the truss member connectors 100*a* to 100*i* bends along its respective indentation 178. It should be appreciated that this bending can be manually performed without tools.

After bending, the primary truss members 910*a*, 910*b*, and 910*c*, the additional reinforcing members 940*a*, 940*b*, and 940*c*, and the truss member connectors 100*a* to 100*i* respectively form generally L shapes with the truss member connectors 100*a* to 100*i* acting as corners of the L shapes (as best shown in FIG. 10). Thus, the additional reinforcing members 940*a*, 940*b*, and 940*c* are rotated into planes generally perpendicular to the respective planes of the primary truss members 910*a* to 910*h* (as best shown in FIG. 10). Once the additional reinforcing members 940*a*, 940*b*, and 940*c* are rotated into place, the primary truss members 910*a*, 910*b*, and 910*c* are strengthened against buckling under compression loads. The truss 900 is then installed (such as lifted with a crane) onto the structure under construction.

It should be appreciated that the embodiment of the truss member connector of the present disclosure can be made of a suitable metal such as steel, or a suitable light gauge metal. It should further be appreciated that the truss member connector of the present disclosure can be made of other suitable materials.

It should be appreciated that in various embodiments, the first and second guide pins may be offset from one another. It should be appreciated that in various embodiments, the attachment ends of the first and second guide pins are along the indentation.

It should be further appreciated that in various embodiments, the truss member connector includes a single guide pin having a flat finger formed as a flap.

It should be further appreciated that in various embodiments, the truss member connector does not include any guide pins.

It should be further appreciated that in various embodiments, the truss member connector does not include an indentation.

It should be further appreciated that reinforcing members may be attached to both sides of a primary truss member for additional reinforcement when required. In such cases the connectors may be on the same side (which facilitate rotation of the reinforcing members toward each other) or on opposite sides (which facilitates rotation of the members away from each other in on sense).

One advantage to using the truss member connector and reinforcing method of the present disclosure is that reinforcing truss members may be attached to primary truss members in a factory setting. Thus, workers at a construction site need not climb onto or be lifted to an installed truss to install reinforcing members. This improves safety and efficiency at the construction site and reduces construction costs.

Another advantage to using the truss member connector of the present disclosure is that the truss member connectors are attached to the primary members and the reinforcing members of a reinforced truss in the same direction as known truss connecting plates (such as downwardly). Thus, the machinery used to construct such reinforced trusses need not be reoriented or substantially modified. This improves safety and efficiency at the truss manufacturer and reduces manufacturing costs.

Another advantage to using the truss member connector and reinforcing method of the present disclosure is that reinforcing members may be made of already-available conventional lumber. Thus, truss manufacturers and installers need not purchase specialized reinforcing members. This reduces the cost of properly reinforced trusses.

Another advantage to using the truss member connector and reinforcing method of the present disclosure is that manufactured reinforced trusses may be tightly stacked flat on top of one another on flat-bed trucks or delivery trailers for transport to construction sites. This improves safety and efficiency of transportation of the trusses.

Another advantage to using the truss member connector and reinforcing method of the present disclosure is that reinforcing members are less likely to be omitted from trusses. This improves the safety and increases the strength of structures built using manufactured trusses.

It should further be appreciated from the above that in various embodiments the present disclosure provides a truss member connector comprising: a first attachment section; a second attachment section; a connection section connecting the first attachment section to the second attachment section; a first guide pin extending from the connection section; and a second guide pin extending from the connection section.

In various such embodiments of the truss member connector, the first attachment section includes a first set of attachment teeth extending from a bottom surface and the second attachment section includes a second set of attachment teeth extending from the bottom surface.

In various such embodiments of the truss member connector, the first and second guide pins are longer than the first and second sets of attachment teeth.

In various such embodiments of the truss member connector, the connection section includes an indentation.

In various such embodiments of the truss member connector, the first and second guide pins extend from a bottom surface of the connection section near the indentation.

In various such embodiments of the truss member connector, the indentation is convex with respect to the bottom surface.

It should also be appreciated from the above that in various embodiments the present disclosure provides a truss member connector comprising: a first attachment section having a first body and a first set of attachment teeth, the first set of attachment teeth extending from a first bottom surface of the first body; a second attachment section having a second body and a second set of attachment teeth, the second set of attachment teeth extending from a second bottom surface of the second body; a connection section connecting the first attachment section to the second attachment section and having a third body, the third body having a third bottom surface and an indentation aligned with the first and second sets of attachment teeth; a first guide pin extending from the third bottom surface near the indentation, the first guide pin being longer than the first and second sets of attachment teeth; and a second guide pin extending from the third bottom surface near the indentation, the second guide pin being longer than the first and second sets of attachment teeth.

In various such embodiments of the truss member connector, the first and second guide pins are configured to slide along a first side of a first truss member and a second side of an additional reinforcing member.

In various such embodiments of the truss member connector, the first and second sets of attachment teeth, the indentation, and the first and second guide pins respectively extend from the first, second, and third bottom surfaces in a first direction.

It should also be appreciated from the above that in various embodiments the present disclosure provides a truss member connector comprising: a first attachment section; a second attachment section; and a connection section connecting the first attachment section to the second attachment section and including an indentation.

In various such embodiments of the truss member connector, the first attachment section includes a first set of attachment teeth extending from a bottom surface and the second attachment section includes a second set of attachment teeth extending from the bottom surface.

In various such embodiments of the truss member connector, the indentation is convex with respect to the bottom surface.

In various such embodiments of the truss member connector, the first and second sets of attachment teeth and the indentation extend from the bottom surface in a first direction.

It should also be appreciated from the above that in various embodiments the present disclosure provides a method of reinforcing a truss member of a truss, the method comprising: positioning an additional reinforcing member next to the truss member of the truss; and attaching the additional reinforcing member to the truss member with a plurality of truss member connectors on only one face of the truss member to enable shipment of the attached reinforcing member flat and subsequent rotation at a construction site of the additional reinforcing member relative to the truss member to a position where the additional reinforcing member adds support and rigidity to the truss member and the entire truss.

In various such embodiments of the method of reinforcing a truss member of a truss, the method includes attaching the additional reinforcing member to the truss member to enable rotation of the additional reinforcing member relative to the truss member about bending axes of the plurality of truss member connectors.

In various such embodiments of the method of reinforcing a truss member of a truss, the bending axes are along indentations in the truss member connectors.

In various such embodiments of the method of reinforcing a truss member of a truss, the bending axes are generally collinear.

In various such embodiments of the method of reinforcing a truss member of a truss, the method includes attaching the additional reinforcing member to the truss member to enable rotation of the additional reinforcing member relative to the truss member such that the additional reinforcing member, the truss member, and the plurality of truss member connectors form a generally L shape.

In various such embodiments of the method of reinforcing a truss member of a truss, the method includes attaching the additional reinforcing member to the truss member such that indentations of the plurality of truss member connectors are aligned with the truss member and with the additional reinforcing member.

It should also be appreciated from the above that in various embodiments the present disclosure provides a method of reinforcing a truss, said method comprising: positioning an additional reinforcing member relative to a truss member; placing a truss member connector on the first truss member and the additional reinforcing member such that a first set of attachment teeth of the truss member connector is on the first truss member, a second set of attachment teeth of the truss member connector is on the additional reinforcing member, and first and second guide pins of the truss member connector extend between the first truss member and the additional reinforcing member; and embedding the truss member connector into the first truss member and the additional reinforcing member such that the first and second guide pins extend further between the first truss member and the additional reinforcing member to enable rotation of the additional reinforcing member relative to the truss member such that the additional reinforcing member, the truss member, and the truss member connector form a generally L shape with the truss member connector acting as a corner of the L shape.

In various such embodiments of the method of reinforcing a truss, the method includes positioning the additional reinforcing member generally in parallel to the first truss member.

In various such embodiments of the method of reinforcing a truss, the method includes positioning the additional reinforcing member next to the first truss member horizontally on a work surface.

In various such embodiments of the method of reinforcing a truss, the method includes positioning the additional reinforcing member relative to the first truss member such that a first side of the first truss member contacts a second side of the additional reinforcing member.

In various such embodiments of the method of reinforcing a truss, the method includes placing the truss member connector on the first truss member and the additional reinforcing member such that the first and second guide pins each contact a first side of the first truss member and a second side of the additional reinforcing member, the first set of attachment teeth contact a first upward face of the first truss member, and the second set of attachment teeth contact a second upward face of the additional reinforcing member.

In various such embodiments of the method of reinforcing a truss, the method includes placing the truss member connector on the first truss member and the additional reinforcing member such that first and second free ends of the first and second guide pins are below a plane formed by the first and second upward faces when the first and second sets of attachment teeth contact the first and second upward faces.

In various such embodiments of the method of reinforcing a truss, the embedding the truss member connector into the first truss member and the additional reinforcing member includes driving the first and second sets of attachment teeth respectively into the first truss member and the additional reinforcing member.

In various such embodiments of the method of reinforcing a truss, the method includes embedding the truss member connector into the first truss member and the additional reinforcing member.

In various such embodiments of the method of reinforcing a truss, the method includes positioning the additional reinforcing member relative to the first truss member such that the first and second truss members are coplanar.

In various such embodiments of the method of reinforcing a truss, the method includes embedding the truss member connector into the first truss member and the additional reinforcing member such that rotation of the additional reinforcing member relative to the first truss member bends the truss member connector.

In various such embodiments of the method of reinforcing a truss, the truss member connector is bendable along an indentation in the truss member connector.

It should also be appreciated from the above that in various embodiments the present disclosure provides a reinforced truss comprising: a plurality of connected truss members; and an additional reinforcing member positioned next to one of the truss members and attached to said truss member by a plurality of truss member connectors such that the additional reinforcing member can be rotated relative to said truss member to a position where the additional reinforcing member adds support and rigidity to said truss member.

In various such embodiments of the reinforced truss, the additional reinforcing member is rotatable relative to said truss member about bending axes of the plurality of truss member connectors.

In various such embodiments of the reinforced truss, the bending axes are along indentations in the truss member connectors.

In various such embodiments of the reinforced truss, the additional reinforcing member is rotatable relative to said truss member such that the additional reinforcing member, the truss member, and the plurality of truss member connectors form a generally L shape.

In various such embodiments of the reinforced truss, the additional reinforcing member lies in substantially the same plane as said truss member prior to rotation of the additional reinforcing member.

It will be understood that modifications and variations may be effected without departing from the scope of the novel concepts of the present invention, and it is understood that this application is to be limited only by the scope of the claims.

The invention is claimed as follows:

1. A truss member connector comprising:

a first attachment section configured to be attached to a first truss member;

a second attachment section configured to be attached to a second truss member such that the second truss member is spaced apart from and does not contact the first truss member;

a connection section connecting the first attachment section to the second attachment section, wherein the first attachment section, the second attachment section, and the connection section are monolithically formed;

a first guide pin extending from the connection section and configured to extend between the first truss member and the second truss member; and a second guide pin extending from the connection section and configured to extend between the first truss member and the second truss member.

2. The truss member connector of claim 1, wherein the first attachment section includes a first set of attachment teeth extending from a bottom surface and the second attachment section includes a second set of attachment teeth extending from the bottom surface.

3. The truss member connector of claim 2, wherein the first and second guide pins are longer than the first and second sets of attachment teeth.

4. The truss member connector of claim 1, wherein the connection section includes an indentation.

5. The truss member connector of claim 4, wherein the first and second guide pins extend from a bottom surface of the connection section near the indentation.

6. The truss member connector of claim 5, wherein the indentation is convex with respect to the bottom surface.

7. A truss member connector comprising:

a first attachment section extending in a first direction and configured to be attached to a first truss member;

a second attachment section extending in a second direction that is opposite to the first direction and configured to be attached to a second truss member such that the second truss member is spaced apart from and does not contact the first truss member; and a connection section connecting the first attachment section to the second attachment section, the connection section including a longitudinal indentation aligned transverse to the first and the second directions, the first and second attachment sections being foldable about a longitudinal axis of the indentation, wherein the first attachment section, the second attachment section, and the connection section are monolithically formed and configured such that after attachment of the first and second attachment sections to the first and second truss members, the second truss member is foldable about the longitudinal axis of the indentation.

8. The truss member connector of claim 7, wherein the first attachment section includes a first set of attachment teeth extending from a bottom surface and the second attachment section includes a second set of attachment teeth extending from the bottom surface.

9. The truss member connector of claim 8, wherein the indentation is convex with respect to the bottom surface.

10. The truss member connector of claim 8, wherein the first and second sets of attachment teeth and the indentation extend from the bottom surface in a first direction.

11. A truss member connector comprising:

a first attachment section having a first body and a first set of attachment teeth, the first set of attachment teeth extending from a first bottom surface of the first body;

a second attachment section having a second body and a second set of attachment teeth, the second set of attachment teeth extending from a second bottom surface of the second body;

a connection section connecting the first attachment section to the second attachment section and having a third body, the third body having a third bottom surface and an indentation aligned with the first and second sets of attachment teeth;

a first guide pin extending from the third bottom surface near the indentation, the first guide pin being longer than the first and second sets of attachment teeth; and a second guide pin extending from the third bottom surface near the indentation, the second guide pin being longer than the first and second sets of attachment teeth.

12. The truss member connector of claim 11, wherein the first and second guide pins are configured to slide along a first side of a first truss member and a second side of an additional reinforcing member.

13. The truss member connector of claim 12, wherein the first and second sets of attachment teeth, the indentation, and the first and second guide pins respectively extend from the first, second, and third bottom surfaces in a first direction.

* * * * *